US005454639A

United States Patent [19]

Krzywdziak

[11] Patent Number: 5,454,639

[45] Date of Patent: Oct. 3, 1995

[54] STIRRER, PARTICULARLY FOR PAINT-STIRRING MACHINES

[75] Inventor: Alain Krzywdziak, Orleans, France

[73] Assignee: Societe Anonyme dite : F.A.S., Orleans Cedex, France

[21] Appl. No.: 233,062

[22] Filed: Apr. 26, 1994

[30] Foreign Application Priority Data

Apr. 27, 1993 [FR] France ..... 93 04949

[51] Int. Cl.[6] ..... B01F 9/16

[52] U.S. Cl. ..... 366/279; 366/249; 366/605

[58] Field of Search ..... 366/279, 244, 366/245, 247, 249, 250, 251, 605, 318, 322, 320, 325, 330

[56] References Cited

U.S. PATENT DOCUMENTS

| | | | |
|---|---|---|---|
| 4,380,399 | 4/1983 | Godat | 366/605 |
| 4,407,584 | 10/1983 | Boudin | 366/279 |
| 4,926,390 | 5/1990 | Murzsa | 366/249 |

FOREIGN PATENT DOCUMENTS

| | | |
|---|---|---|
| 1131721 | 10/1956 | France . |
| 2315001 | 1/1977 | France . |
| 1255460 | 11/1967 | Germany . |
| 1917626 | 10/1970 | Germany . |

OTHER PUBLICATIONS

Derwent Abstract No. 90–367 322/49, SU–A–1 540 852. (No Date).

*Primary Examiner*—Robert W. Jenkins
*Attorney, Agent, or Firm*—Scully, Scott, Murphy & Presser

[57] ABSTRACT

The invention relates to a stirrer, particularly for paint-stirring machines.

This stirrer is provided with at least two blade elements (13), the surface of which has helicoid development, these being fixed with equilibrium of the rotation to the shaft, at least one of the blade elements being formed along a generatrix (5) in the horizontal plane including, over at least a part of its length, curvature in a spiral shape relative to a point forming a pole (I), for example on the stirring shaft.

8 Claims, 1 Drawing Sheet

STIRRER, PARTICULARLY FOR PAINT-STIRRING MACHINES

The invention relates to stirrers, particularly for paint-stirring machines.

Stirrers are known for a paint-stirring machine, which are provided with a conventional continuous helicoidal blade, the generatrix line of which in the horizontal plane is rectilinear.

The invention aims to propose improving the effectiveness of stirrers for pots of paint of paint-stirring machines.

In effect, according to the invention, a stirrer is proposed intended particularly for stirring paint in paint-stirring machines, consisting of a conventional stirring shaft moved in terms of rotation and of at least one blade element for mixing up the paint, characterized in that at least two blade elements are provided, the surface of which has helicoidal development, these being fixed with equilibrium of the rotation to the shaft, at least one of the blade elements being formed along a generatrix in the horizontal plane including, over at least a part of its length, curvature in a spiral shape relative to a point forming a pole, for example on the stirring shaft.

This spiral is preferably a logarithmic curve, the pole I of which is on the shaft of the stirrer, namely defined by the locus of the points M, whose distance 1 to the point I is such that $1=ae^{mw}$, a and m being scalar and w, the angle of the points with respect to an angular reference direction.

The two blade elements are advantageously formed symmetrically with one another with respect to a vertical mid-plane of the stirrer.

The lower edge of the blade elements is formed in a horizontal plane a slight distance from the bottom of the tin. The external edge of the blade is defined as the intersection of the helicoid surface of the blade and of a cylinder of radius slightly less than that of the tin in which it is contained. The upper edge is cut out in the shape of a raised spoiler making sure that the paint is propelled onto the side wall of the tin.

Figure 1:
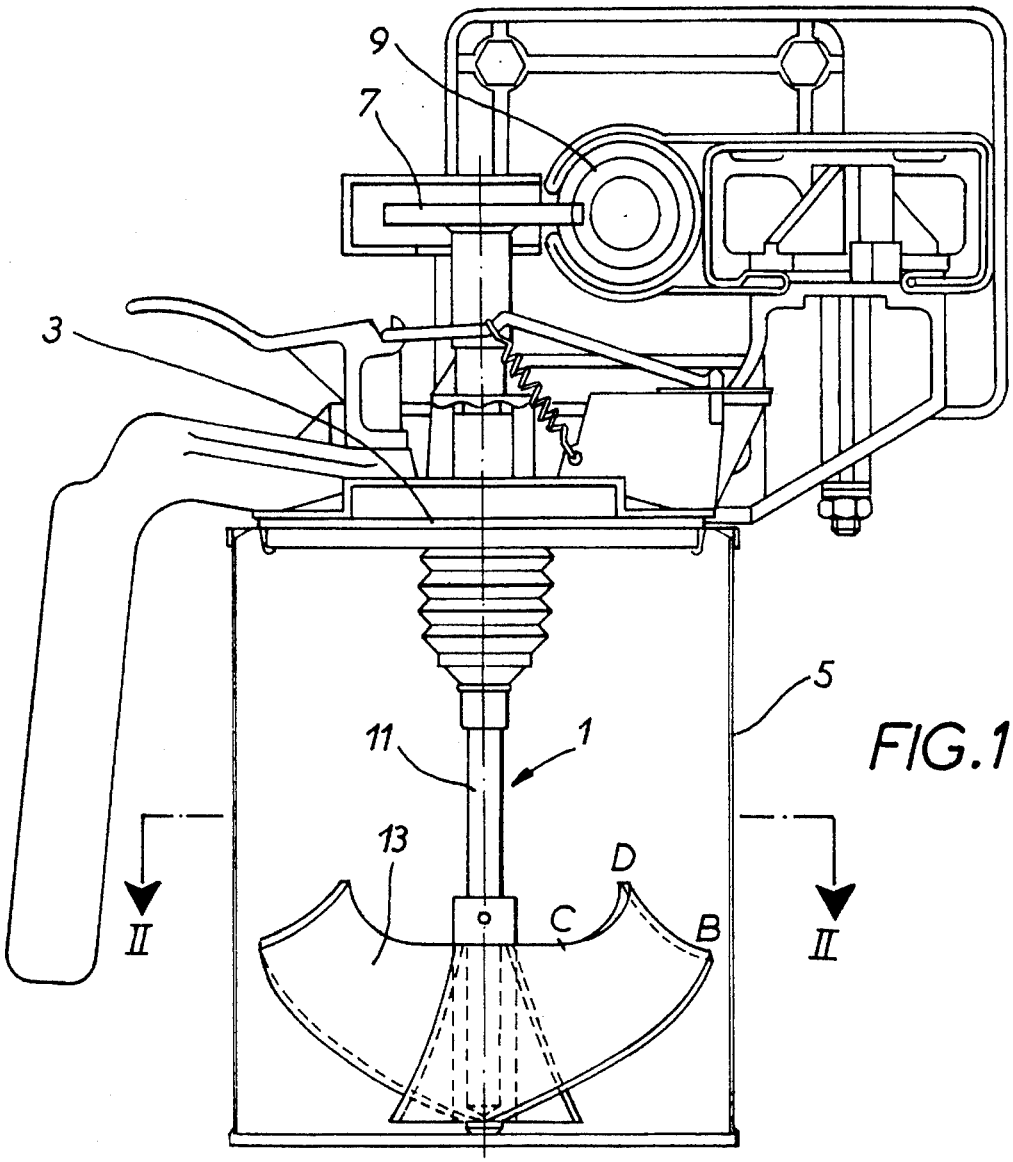
Figure 2:
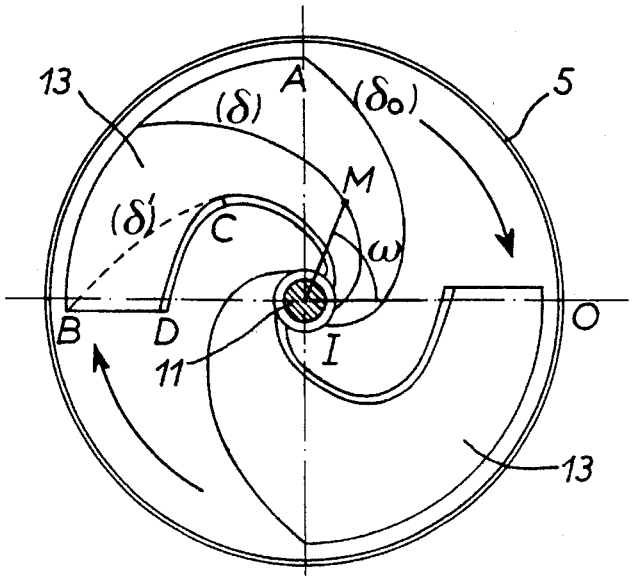

One embodiment of the invention is described below with reference to the appended drawing in which:

FIG. 1 is a vertical section through the middle of a pot for a paint-stirring machine equipped with a stirring shaft according to the invention, and FIG. 2 is a view on the line II—II of FIG. 1.

As represented in the drawing, the stirring shaft 1 according to the invention is mounted on a stirring lid 3, itself accommodated on a tin of paint 5 to be stirred. The lid with its tin is mounted on a paint-stirring machine, itself carrying numerous other paint pots and lids. The stirrer is rotationally driven on the lid by means of an upper pinion 7 meshing with a rotary worm 9.

The stirring shaft is made up of a shank 11 embedded in the middle part of the tin and provided with two blade elements 13 which are fixed to its lower part. The stirrer rotates in the direction indicated by the arrows. The two blade elements are symmetric with one another with respect to a vertical mid-plane. They each include a helicoidal surface developed vertically relative to the axis of the stirrer shank 11. The generatrix in the horizontal plane which corresponds to the intersection of this surface with respect to any horizontal plane is a curve in the shape of a logarithmic spiral—only one curve (5) at an intermediate altitude is represented—defined as the locus of the points M where, with respect to the point I on the shaft, in the plane, the distance IM=1 is linked by the relation $1=ae^{mw}$, w being the angle (IO, IM). The point I is an asymptotic pole of the curve. The numbers a and m are scalar and constitute the parameters of the spiral. These parameters are variable particularly as a function of the dimensions of the blade and therefore of the pot which receives it. Thus, the tangent at M to the spiral forms a constant angle with the radius IM. These blade elements, just one of which is described owing to the symmetry, include a horizontal lower edge of curvature 5. close to the flat bottom of the tin. This curvature 5. is naturally of logarithmic development, in a similar way to (5). The upper edge is made up of a portion of curve IC developed along a logarithmic curve 5' similar to 5 and 5 and by a portion CD raised upwards. The external edge AB is defined as the intersection of the helicoid and of a cylinder of radius slightly less than that of the tin. The raised portion CD forms a spoiler-shaped part conducive to the mixing-up of the paint toward the side wall of the tin.

This stirrer shape with two blades of helicoidal surface in a logarithmic spiral has unexpectedly demonstrated an effectiveness markedly greater than that of conventional stirring systems, particularly in the vertical mixing-up of the paint. The means with conventional boss [sic] allowing the stirrer to be given a vertical vibrational movement parallel to the rotation are not strictly necessary, taking account of the effectiveness of the stirring obtained.

Naturally, a device for scraping the bottom, having the form of a rotationally driven conventional spring wire may be added to the system, fixed to the base of the stirrer shank.

In addition, this device with a blade with spiral-shaped curvature in the plane and developed into a helicoid along the stirring shaft may be used on machines with suspended pots or placed pots and possibly for stirring other fluids, the viscosity of which is close to that of paint.

Moreover, the number of blades may vary; it may be 3, 4, with an angular layout of the blades respectively at 120° and 90°, and consequently a regular angular layout for dynamic equilibrium of the rotation. Optionally, the conventional blade elements may be joined, it still being necessary for the stirrer to be balanced at its rotational speed.

The curvature in a spiral in the plane may even by of hyperbolic expression, or of so-called Archimedes' expression, the pole remaining at the center of the shaft.

Finally, the blade surface may include sectors of varied shapes, developed for example into a spiral in the plane over a certain portion of height or of its width and of conventional curvature on another, thus developing differential effects on each sector in the mixing-up of the paint.

I claim:

1. Stirrer for stirring paint in cans arranged in paint-stirring machines, comprising an elongate rotatable stirring shaft (11) insertable into said cans and including blade means for mixing the paint, said blade means including at least two blade elements (13) fastened to said shaft for rotation therewith, each having a surface which defines a helicoid development, said blade elements positioned to impart an equilibrium to the rotation of the shaft, at least one of the blade elements being formed along a generatrix (5) in a plane transverse of the longitudinal axis of said stirring shaft and including over at least a part of its length a curvature defining a spiral shape relative to a point forming an imaginary pole (I) located on the longitudinal axis of the stirring shaft.

2. Stirrer according to claim 1, wherein said generatrix defines a logarithmically curved spiral.

3. Stirrer according to claim 1, wherein said generatrix defines a hyperbolically curved spiral.

4. Stirrer according to claim 1, wherein said spiral is a curve for mixing said paint pursuant to Archimedes' law.

5. Stirrer according to claim 1, wherein said blade elements (13) are formed symmetrically relative to each other about a vertical mid-plane of the stirrer.

6. Stirrer according to claim 1, wherein a plurality of said blade elements (13) are evenly angularly distributed about said stirring shaft for dynamic balancing of the rotation of said shaft.

7. Stirrer according to claim 1, wherein the blade surface of each blade element (13) includes sectors of varied shapes, developed into spirals in the plane over a specified portion of the height and width and of specified curvature in elevation for developing differing effects in the mixing of the paint.

8. Stirrer according to claim 1, wherein said blade elements (13) each include at an upper portion thereof an element having the form of a spoiler promoting the mixing of the paint toward an interior side wall of the can of paint.

* * * * *